United States Patent [19]

Tacq

[11] Patent Number: 4,903,739

[45] Date of Patent: Feb. 27, 1990

[54] METHOD FOR THREADING A PICK INSERTION DEVICE ON WEAVING MACHINES, AND A DEVICE WHICH USES THIS METHOD

[75] Inventor: Jo Tacq, Ieper, Belgium

[73] Assignee: Picanol N.V., Belgium

[21] Appl. No.: 185,047

[22] Filed: Apr. 22, 1988

[30] Foreign Application Priority Data

May 12, 1987 [BE] Belgium ..... 8700520

[51] Int. Cl.[4] ..... D03D 47/30

[52] U.S. Cl. ..... 139/435.3

[58] Field of Search ..... 139/435, 453, 450

[56] References Cited

U.S. PATENT DOCUMENTS

| | | | |
|---|---|---|---|
| 4,366,845 | 1/1983 | Simson | 139/435 |
| 4,756,342 | 7/1988 | Van Bogaert | 139/435 |
| 4,813,460 | 3/1989 | Van Bogaert et al. | 139/435 |

FOREIGN PATENT DOCUMENTS

| | | | |
|---|---|---|---|
| 59545 | 4/1984 | Japan | 139/435 |
| 124650 | 6/1986 | Japan | 139/435 |
| 1150077 | 4/1969 | United Kingdom . | |

*Primary Examiner*—Henry S. Jaudon

*Attorney, Agent, or Firm*—Bacon & Thomas

[57] ABSTRACT

Method for threading a weft insertion device on weaving machines, in particular for threading a weft insertion device of the type which consists of at least one first nozzle (3, 4) mounted beside the sley (7) and at least one second nozzle (5, 6) which moves with the sley (7), where the first nozzle (3, 4) makes an angle with the second nozzle (5, 6) and during normal operation of the weaving machine lies at a distance from it, with the characteristic that the method consists essentially of presenting to one another the thread exit opening (17) and thread induction opening (15) of the first and second nozzles respectively (3, 4; 5, 6), and then leading a weft thread (19, 20) through both nozzles (3, 5; 4, 6); the invention also concerns a device which uses this method.

13 Claims, 4 Drawing Sheets

METHOD FOR THREADING A PICK INSERTION DEVICE ON WEAVING MACHINES, AND A DEVICE WHICH USES THIS METHOD

This invention concerns a method for threading a pick insertion device on weaving machines, in particular on weaving machines which use a pick insertion device including at least one first independent nozzle mounted beside the sley and at least one second nozzle which moves with the sley, wherein the first nozzle is mounted at an angle to the second nozzle and wherein during normal operation of the machine the two nozzles remain at a certain distance from each other. The invention also concerns a pick insertion device which uses the method of the invention.

BACKGROUND OF THE INVENTION

Devices which use a first nozzle mounted on the machine frame beside the sley and a second nozzle mounted on the sley are generally known. If both nozzles are close together with their axes parallel to each other, then threading or rethreading is not a problem. The second nozzle can be lined up with the first simply by moving the sley, and since the separation between them is very small a weft thread can be blown from the first nozzle directly into the second nozzle with a high degree of certainty.

However, the wo nozzles cannot be rethreaded automatically in this way if the first and second nozzles are at an angle to each other and moreover at a greater distance from each other. This is the case particularly on machines in which several different colors or types of weft yarn are woven. On such machines there is a first and second nozzle for each color; the nozzles on the sley are mounted side by side while the first nozzles are mounted apart from each other, with their thread induction openings pointing towards the respective weft accumulator devices. In order to carry out rethreading, the weft thread first has to be led through the corresponding first nozzle and then gripped and presented to the thread induction opening of the second nozzle, in order to thread the second nozzle.

SUMMARY OF THE INVENTION

The aim of the present invention is to provide a method which enables the first and second nozzles to be rethreaded in a single operation. The method consists essentially of moving the first and second nozzles to be rethreaded and presenting their thread induction and thread exit openings to each other, and then leading a weft thread through both nozzles by presenting it to the thread induction opening of the first nozzle and generating an airstream through at least one of the nozzles.

In a preferred embodiment, the movement of the nozzles with respect to each other is obtained by rotating the corresponding first nozzle towards the second nozzle so as to bring the two nozzles into line with each other.

The present invention also concerns a pick insertion device which incorporates a mechanism for carrying out this method.

BRIEF DESCRIPTION OF THE DRAWINGS

For the purpose of explaining the characteristics of the invention, the following examples are described, by way of example only and without being limitative in any way, with reference the accompanying drawings, where.

DESCRIPTION OF THE PREFERRED EMBODIMENTS OF THE INVENTION

Figure 1:
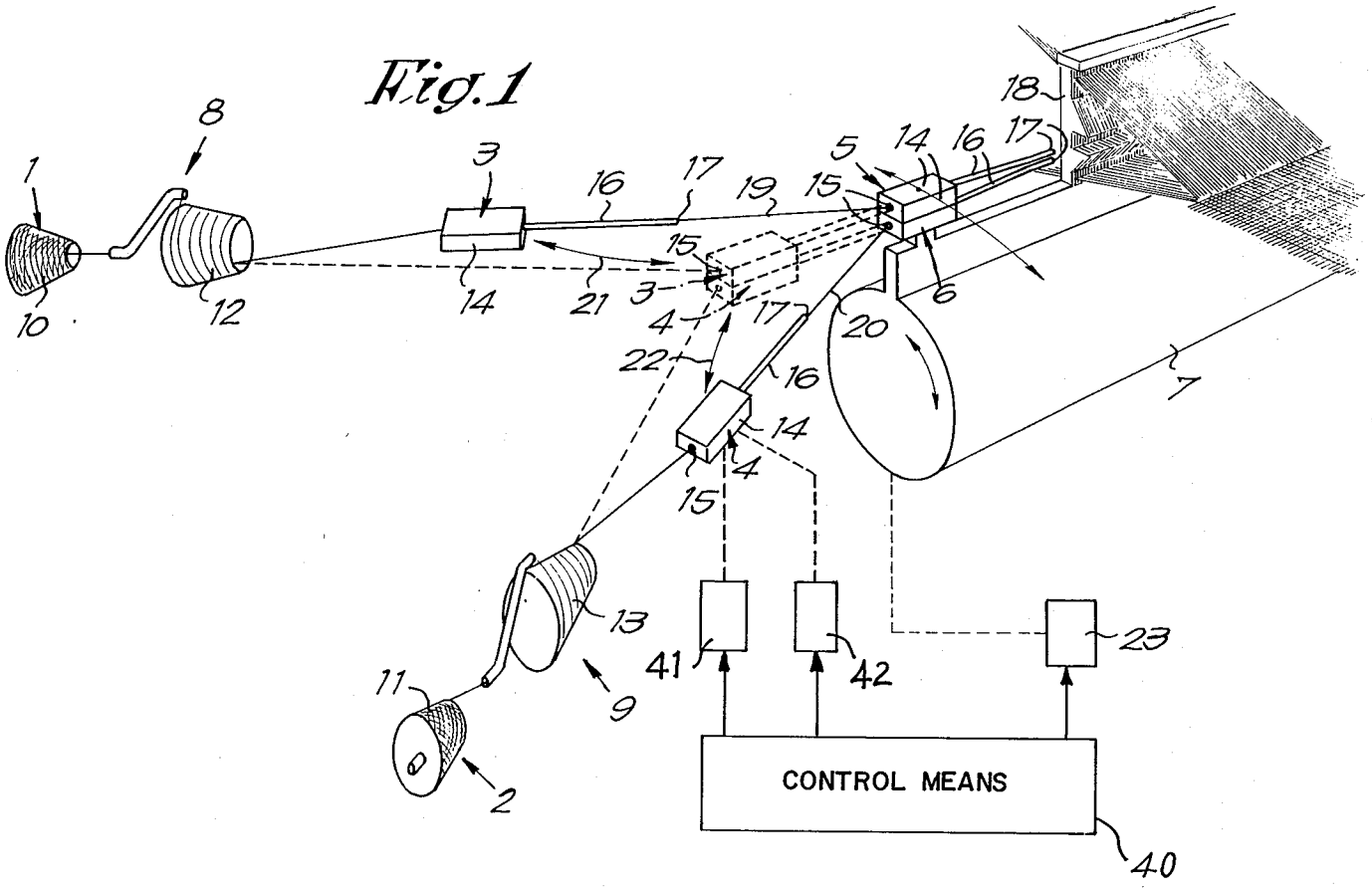
FIG. 1 is a schematic representation of the method according to the invention.

FIG. 1 is a schematic representation of a pick insertion mechanism of the abovementioned type; the embodiment shown is for a weaving machine that works with two weft threads 1 and 2. For each of these weft threads 1 and 2 there is a first nozzle, 3 and 4 respctively, and a second nozzle, 5 and 6 respectively. As explained in the preamble, the two second nozzles are mounted on the sley 7 of the weaving machine; in the arrangement shown these two nozzles 5 and 6 are mounted one on top of the other. The two first nozzles 3 and 4 are positioned between the respective yarn supply devices 8 and 9 and the nozzles 5 and 6 mounted on the sley 7. The fact that the yarn supply devices 8 and 9 are relatively bulky explains why the first nozzles 3 and 4 are mounted converging, so that they are at an angle to the nozzles 5 and 6 mounted on the sley 7.

The yarn supply devices 8 and 9 shown in FIG. 1 each consist of, for example, a yarn package of bobbin 10 and 11 and a prewinder 12 and 13. All the abovementioned nozzles 3 to 6 consist of, for example, an nozzle body 14 with a thread induction opening 15 and a compressed air connection (not shown), together with a mixer tube 16 at the end of which is the thread exit opening 17. Also in FIG. 1, part of the U-shaped weft guide 18 can be seen.

Since the distance between each of the first nozzles 3 or 4 and the corresponding second nozzle 5 or 6 is usually a few centimeters, and since the first and second nozzles are at an angle to each other, it is not possible to blow a weft thread 19 or 20 directly from the first nozzle 3 or 4 directly into the corresponding second nozzle 5 or 6. In the method according to the invention, a solution is provided by bringing the sley 7 into a predefined position stopping the sley, and then presenting the first and second nozzles with their thread exit opening 17 and thread induction opening 15 opposite each other. This is done by positioning the nozzles next to each other so that both the nozzles to be thraded, i.e. 3 and 5 or 4 and 6, effectively form a single communicating thread guide, so that the corresponding weft thread 19 or 20 can be led through both nozzles in a single operation. In FIG. 1, this is done by moving the first nozzles 3 and 4 over the path 21 or 22 (the nozzles may or may not be moved simultaneously) so that they are presented against—or nearly against—the second nozzles 5 and 6.

In a preferred embodiment of the invention, the displacements 21 and 22 are preferably such that the first nozzles 3 and 4 are placed in line with the second nozzles 5 and 6, as shown by the dotted line in FIG. 1, or at least so that the angle between the nozzles presented to each other in this way is made smaller and reduced to a minimum, thus affording the easiest possible transfer between the first and second nozzles.

Once the nozzles to be rethreaded have been moved so that they are presented to each other, and assuming an unthreaded condition, a weft from each respective supply is lead to the nozzles 3 and/or 4 which is/are then activated to draw in the weft thread end/or ends. The weft thread end(s) are then drawn through the nozzles 5 and/or 6 associated with and in communication with nozzles 3 and/or 4, respectively, by the same airstream used to activate the nozzles 3–4, or alternatively, the second nozzles 5 and 6 can be activated to achieve the threading. Still further alternatively, the first and second nozzle set 3–4 and or 5–6 can both be activated to achieve the rethreading. Once rethreading has been carried out, the first nozzles 3 and/or 4 are returned to their normal position and the weaving process can commence.

In order to carry out operation described above, the sley 7 must of course be brought into the correct position; a suitable mechanism 23 for controlling the position of the sley 7 is provided for this purpose. Such a mechanism 23 may, for example, include a limit switch (this is common technology and needs no further description) or suitable electronic stopping controls such as disclosed in U.S. Pat. No. 4,488,580, granted Dec. 18, 1984, U.S. Pat. No. 4,553,569 granted Nov. 19, 1985, U.S. Pat. No. 4,570,681 granted Feb. 18, 1986, or U.S. Pat. No. 4,494,203 granted Jan. 15, 1985 which when the machine stops ensures that the sley always comes to rest in the same position, e.g. in the farthest back position of the reed 18. Alternatively, the mechanism 23 may consist of an automatic circuit which when the nozzles 3–4 and/or 5–6 are to be rethreaded automatically brings the sley 7 into the required position.

The air supply to each of nozzles 3 and 4 is controlled by a control means 41 and movement of the nozzles 3 and 4 is controlled by control means 42. Each of the control means 41 and 42, and mechanism 23, is subject to a main control means 40 which sequences the various operations. The control means are, as noted above, common technology which could be easily implemented by one skilled in the art based on the above description of their functions.

Figure 2:
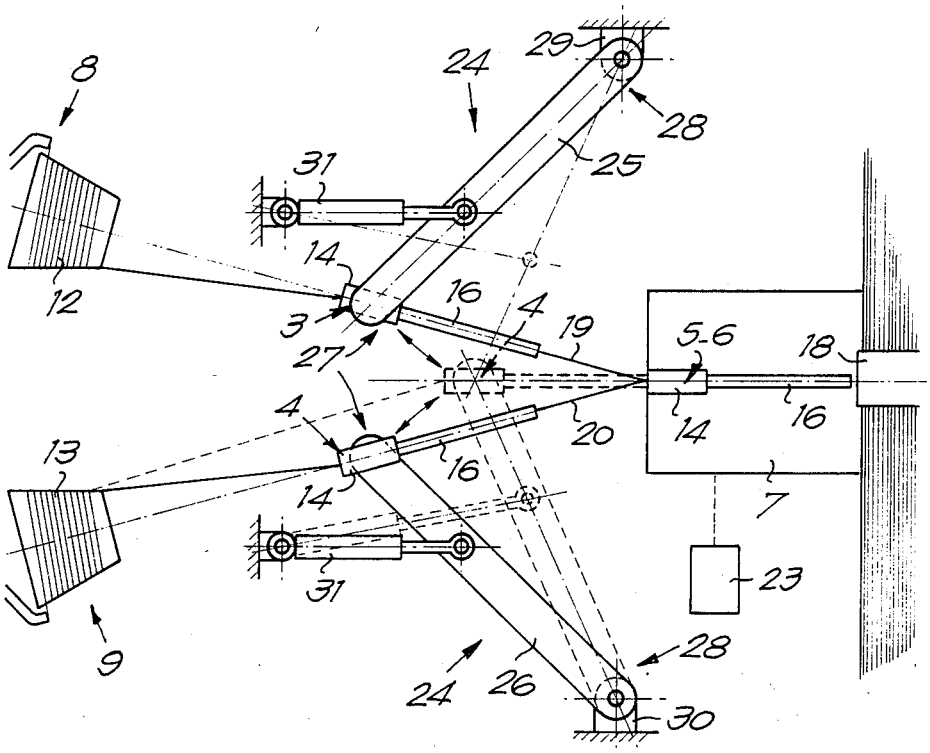
FIG. 2 shows a pick insertion device according to the invention.
Figure 3:
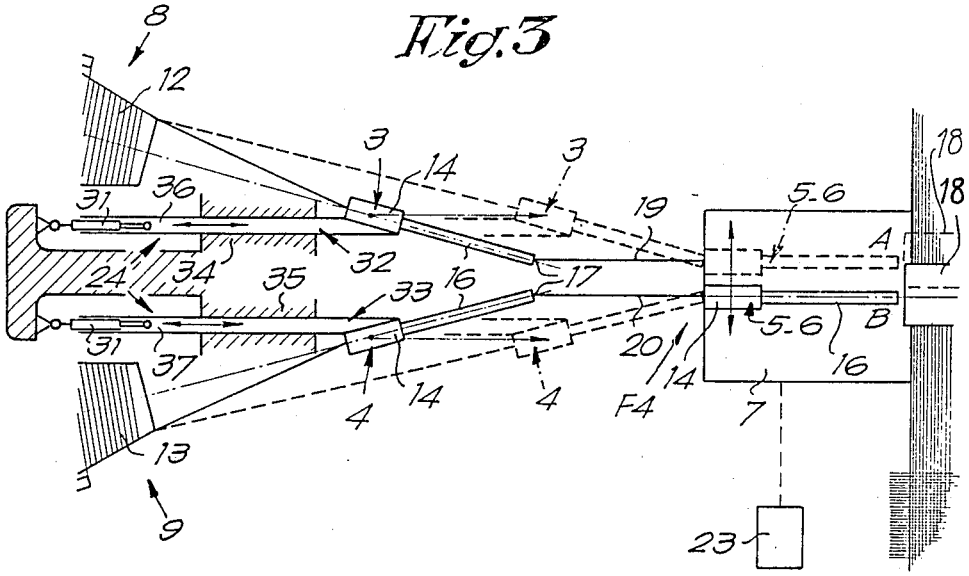
FIG. 3 shows another pick insertion device according to the invention.

FIG. 2 shows a practical embodiment of a pick insertion device equipped with a mechanism 24 for effecting the displacements 21 and 22 of the first nozzles 3 and 4 in the way shown in FIG. 1. This mechanism 24 consists of swivelling arms 25 and 26, which at one end 27 carry the nozzles 3 and 4 and at the other end 28 are swivel-mounted on a fixed support e.g., the frame of the weaving machine or similar support, 29 and 30 respectively. The mechanism 24 further includes a drive unit 31 in order to move the swivelling arms 25 and 26 over a particular angle. The drive unit 31 may consist of pneumatic or hydraulic cylinders, as shown in FIG. 2, but clearly some other type of drive may also be used for this purpose. As shown in FIG. 3, drive means 31 is connected to the frame of the loom, although it is clear that it could be connected to any fixed structure.

Here it should be noted that in FIG. 2 the configuration of the supports or swivel points 29 and 30 with respect to the various nozzles 3 to 6 is chosen so that when the first nozzle 3 or 4 is presented to the second nozzle 5 or 6, they are in line with each other, as indicated for the first nozzle 4 by the dotted lines. The operation of the pick insertion system, more particularly the displacement of the first nozzle 3 and/or 4, can simply be deduced from FIG. 2.

FIG. 3 shows another embodiment of the pick insertion device according to the invention, in which the abovementioned mechanism 24 for displacing the first nozzle 3 and 4 is formed by translation devices 32 and 33, consisting respectively of slides 36 and 37 on which are mounted the nozzles 3 and 4. The slides 36 and 37 travel in guides 34 and 35, oriented in this case in line with the pick, under the action of a drive unit 31. Here it should be noted that when the first nozzles 3 and 4 are in their normal position their thread exit openings 17 are close to one another. The second nozzles 5 and 6 are, for example, mounted one above the other, in a similar way to that shown in FIG. 1. The sley 7 can be brought into either of two positions A and B by means of the abovementioned mechanism 23, so that the pair of nozzles 5 and 6 can be positioned parallel to the direction of the pick, either in front of the thread exit opening 17 of the nozzle 3 or in front of the thread induction opening of the nozzle 4.

If a particular set of cooperating nozzles, i.e., 3–5 or 4–6 need to be rethreaded, the sley 7 is moved into position A or B, respectively, depending upon whether nozzle set 3–5 or 4–6 is to be rethreaded. The relevant first nozzle is then displaced so that it takes up a position indicated by the dotted line in the diagram. The sley position control mechanism 23 is therefore a multi-position control, so that it can be brought into one of several positions, depending on the number of nozzles.

This means that, for example, when the first nozzle 3 and the second nozzle 5 are to be rethreaded, the sley 7 is first brought into position A. The slide 36 is then displaced by the drive unit so that the first nozzle 3 is brought into the position shown by the dotted line. Once rethreading has been carried out, the first nozzle 3 is returned to its normal position and the weaving process can recommence.

Clearly, the two translation devices 32 and 33 may or may not share the same drive.

Figure 4:
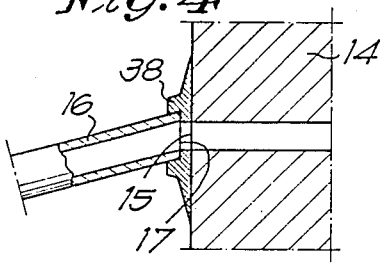
FIG. 4 is a view of the section indicated in FIG. 3 by F4, to a greater scale.
Figure 5:
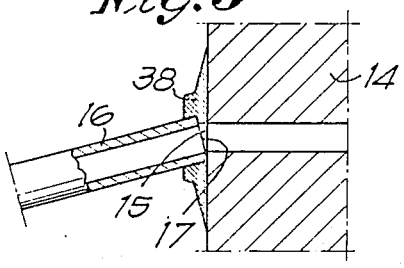
FIGS. 5 and 6 show variants of the embodiment shown in FIG. 4.
Figure 6:
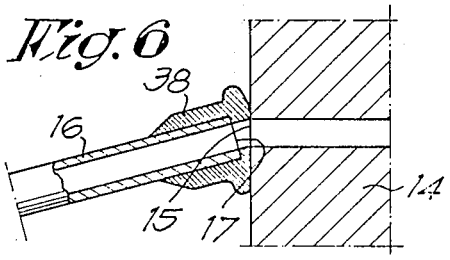

As shown in FIGS. 4 to 6, an elastic collar 38 can be fitted round the thread exit opening 17 of the first nozzle 3 or 4 and/or the thread induction opening 15 of the second nozzle 5 or 6, in order to give a good connection between them. In the embodiment shown in FIGS. 4 and 5, the elastic collar is fitted on the nozzle body 14, while in the embodiment shown in FIG. 6 the collar 38 is fitted on the end of the mixing tube 16.

Figure 7:
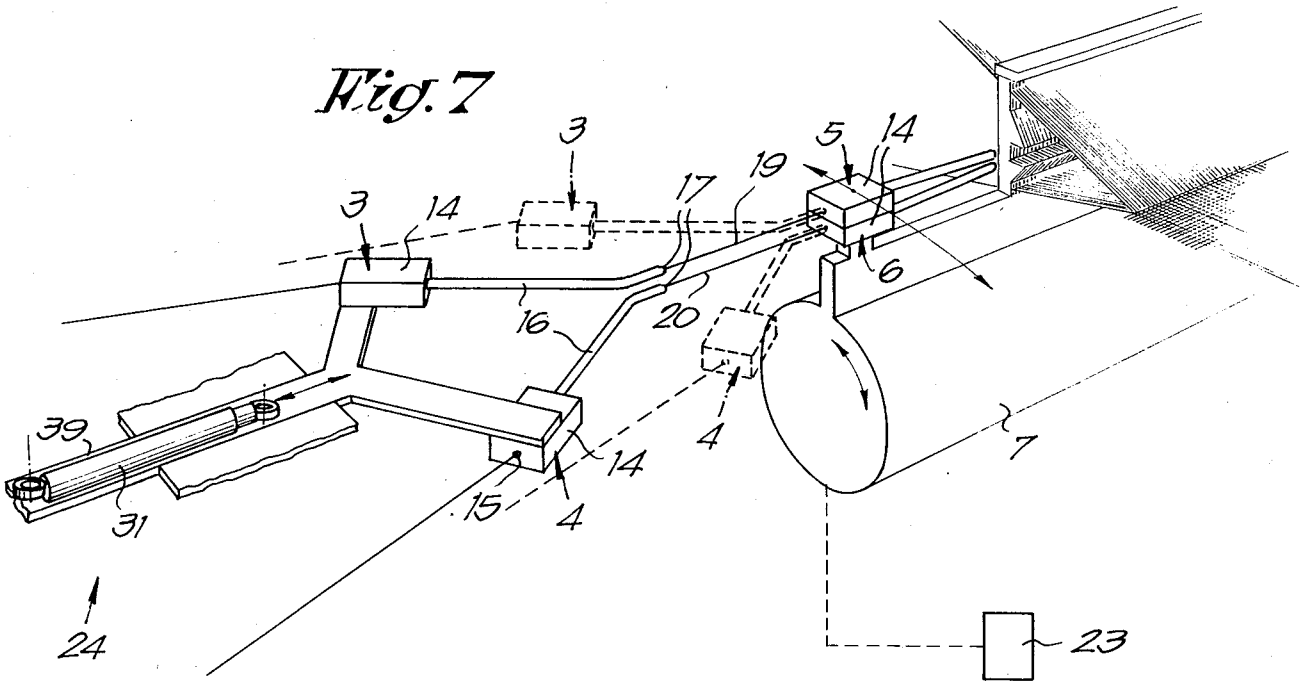
FIG. 7 shows yet another pick insertion device according to the invention.

FIG. 7 shows yet another variant of the pick insertion device, in which the second nozzles 5 and 6 are each positioned in a way similar to that shown in FIG. 1. The thread exit openings 17 of the first nozzles 3 and 4 are situated so that they can be moved simultaneously to directly in front of the thread induction openings 15 of the nozzles 5 and 6. The position of the two first nozzles 3 and 4 is controlled by a mechanism 24 which in this case consists of a common translation device 39 formed by a movable frame, or similar, and a drive 31, arranged so that when the frame is moved the first nozzles 3 and 4 are presented simultaneously to the corresponding second nozzles 5 and 6, as shown by the dotted lines. Clearly, in this case it is not necessary to have a control mechanism with two positions A and B for the sley 7.

Clearly, the method according to the invention is not limited to weft insertion devices for two weft threads 1 and 2, but can also be used for devices with one weft thread or more than two.

This invention is not limited to the embodiments described by way of example and shown in the diagrams; on the contrary it can be made in various forms and dimensions while still remaining within the scope of the invention.

I claim:

1. A method for threading a weft insertion device on a weaving machine of the type including a sley, said weft insertion device including at least one first nozzle mounted beside the sley and at least one second nozzle arranged to move with the sley, said method comprising: maintaining the first nozzle a distance from the second nozzle during normal operation of the weaving machine and/oriented relative to the second nozzle such that threading the first and second nozzles from a single weft supply by blowing the weft thread from a thread exit opening of the first nozzle into a thread induction opening of the second nozzle is normally uncertain, upon occurrence of an unthreaded condition of the nozzles, moving the sley to a pre-determined stopped position, operating the weaving to cause machine thread exit opening of the first nozzle to be presented to said respective thread induction opening of the second nozzle by moving the nozles relative to each other, and, while the weaving machine is stopped, leading a weft thread to be threaded through both nozzles by first presenting the weft thread to the thread induction opening of the first nozzle and generating an airflow through at least one of said first and second nozzles.

2. A method as claimed in claim 1, wherein the first nozzle is presented to the second nozzle by moving it up to the second nozzle, said second nozzle remaining stationary during movement of said first nozzle.

3. A method as claimed in claim 2 wherein the first nozzle normally makes an angle with the second nozzle, and is moved up to the second nozzle in a rotating motion, so that an angle including the corresponding first and second nozzles and having a vertex at the center of rotation is reduced.

4. A method as claimed in claim 3, wherein as a result of the movement of the corresponding first nozzle towards the second nozzle, the nozzles are brought into line with each other.

5. A method as claimed in claim 2, wherein the first nozzle is moved up to the second nozzle by a linear motion.

6. A method as claimed in claim 2, wherein there are several first and second nozzles, and wherein corresponding first and second nozzles are presented to each other simultaneously.

7. A weft threading device for a weaving machine which includes a sley, comprising at least one first nozzle having thread induction and exit openings mounted beside the sley and at least one second nozzle having a thread induction opening arranged to move with the sley, wherein the first nozzle during normal operation of the weaving machine lies at a distance from the second nozzle, said weft insertion device further comprising means for moving said first nozzle towards said second nozzle whereat said induction opening of said first nozzle is arranged to receive a weft thread end to be threaded, and means for moving the sley into at least one predefined stopped position, said thread exit opening of the first nozzle being presented to said thread induction opening of the second nozzle following the movement of the first nozzle when the sley is located at said predefined stopped position, and means for generating an airflow through at least one of said first and second nozzles whereby a weft thread presented to the induction opening of the first nozzle will be advanced through both nozzles.

8. A weft insertion device as claimed in claim 7, wherein said means for moving said first and second nozzles towards each other comprises a swivel arm for said first nozzle which, on its free end, carries the first nozzle, and drive means for moving the swivel arm so as to move said first nozzle towards said second nozzle.

9. A weft insertion device as claimed in claim 7, wherein said means for moving the said first nozzle comprises means on which said first nozzle is mounted for linear movement, and drive means for moving said translation means.

10. A weft insertion device as claimed in claim 9, wherein said weft insertion device is fitted with two first and two second nozzles, the second nozzles being mounted one on top of the other on the sley, said nozzle moving means including means for bringing said thread exit openings of the first nozzles simultaneously up to the thread induction openings of the corresponding second nozzles and in line with the pick, and wherein both of the first nozzles are mounted on a common one of said translation means which can move into line with the pick.

11. A weft insertion device as claimed in claim 7, said device including a plurality of first and second nozzles and wherein said nozzle moving means includes means for presenting respective first and second nozzles to each other at different points beside the sley, and wherein said means for moving the sley into at least one predefined position comprises a multi-position control.

12. A weft insertion as claimed in claim 7, further comprising an elastic collar around the thread induction opening of the body of said second nozzle.

13. A weft insertion device as claimed in claim 7, further comprising an elastic collar round the free end of a mixer tube of said first nozzle.

* * * * *